US005133946A

United States Patent [19]

Schwarzl

[11] Patent Number: 5,133,946

[45] Date of Patent: Jul. 28, 1992

[54] PROCESS FOR BLEACHING CELLULOSIC MATERIALS AND PLANT FOR CARRYING OUT THE PROCESS

[75] Inventor: Karl Schwarzl, Mitterndorf-Traunkirchen, Austria

[73] Assignee: Schmidding-Werke Wilhelm Schmidding, Austria

[21] Appl. No.: 626,012

[22] Filed: Dec. 12, 1990

[30] Foreign Application Priority Data

Dec. 22, 1989 [AT] Austria ..... 2927/89

[51] Int. Cl.[5] ..... B01J 19/08

[52] U.S. Cl. ..... 422/186.12

[58] Field of Search ..... 422/186, 186.04, 186.05, 422/186.07, 186.08, 186.09, 186.1, 186.11, 186.12, 186.23, 186.3, 186.14, 906, 907; 162/9, 6, 17

[56] References Cited

U.S. PATENT DOCUMENTS

| | | | |
|---|---|---|---|
| 2,812,861 | 11/1957 | Bickford | 422/186.04 |
| 2,864,757 | 12/1958 | Balcar et al. | 422/186.04 |
| 3,663,357 | 5/1972 | Liebergott | 162/65 |
| 4,462,965 | 7/1984 | Azuma et al. | 422/186.08 |
| 4,816,229 | 3/1989 | Jensen et al. | 422/186.02 |
| 4,834,837 | 5/1989 | Loquenz et al. | 162/19 |
| 4,902,381 | 2/1990 | Meredith | 162/65 |

*Primary Examiner*—Brooks H. Hunt
*Assistant Examiner*—Daniel J. Jenkins
*Attorney, Agent, or Firm*—Ostrolenk, Faber, Gerb & Soffen

[57] ABSTRACT

There is disclosed a process and a plant for bleaching cellulosic materials by aid of ozone. A concentrated solution of ozone in an aqueous medium (strong water) is supplied under pressure to the materials suspended in an aqueous medium and is mixed therewith in a mixing device. The mixture is conducted through a reaction vessel, the bleached material is separated from the bleaching liquor, and possibly present residual ozone is destroyed. The plant includes an arrangement for preparing a pulp suspension, at least one bleaching tower to receive the mixture of pulp suspension and concentrated ozone solution, an arrangement for producing an ozonic gas, filtering means, pumps and ducts for connecting the plant parts. The arrangement for producing ozone is flow-connected with an absorption column for preparing the concentrated ozone solution and a mixing arrangement is provided for mixing the pulp suspension with the concentrated ozone solution. The mixing arrangement is connected with the absorption column via a strong water duct. The absorption column, the mixing arrangement and the bleaching tower are equipped with means for generating and adjusting an overpressure.

15 Claims, 1 Drawing Sheet

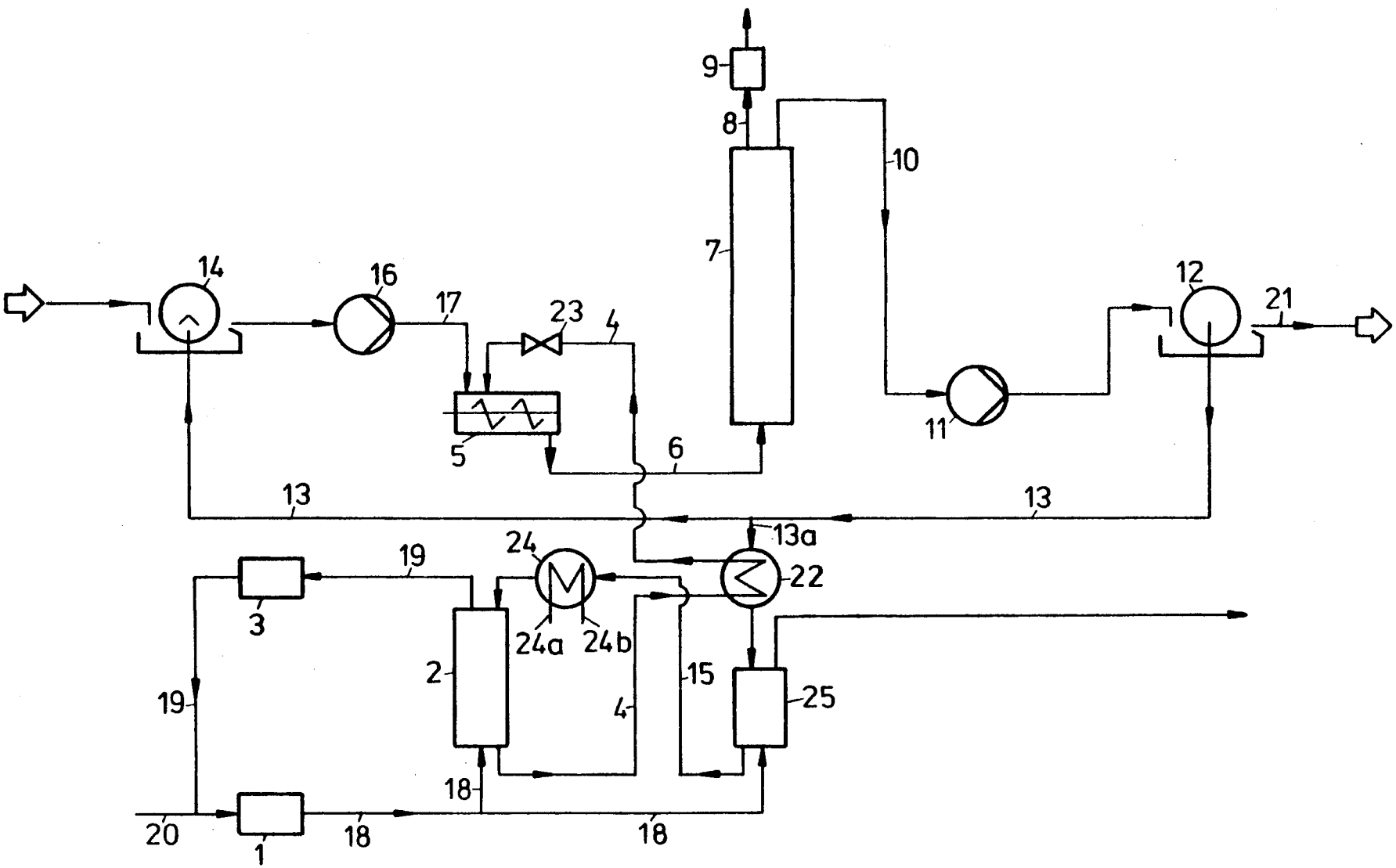
1
2
3
4
5
6
7
8
9
10
11
12
13
13a
14
15
16
17
18
19
20
21
22
23
24
24a
24b
25

PROCESS FOR BLEACHING CELLULOSIC MATERIALS AND PLANT FOR CARRYING OUT THE PROCESS

BACKGROUND OF THE INVENTION

1. Field of the Invention

The invention relates to a process for bleaching cellulosic materials, in particular pulp, by means of ozone as well as to a plant for carrying out the process.

2. Description of the Related Art

It is known that ozone is an lent bleaching agent for pulp. According to the so-called high-consistency process, pulp at first is brought to high consistencies of above 25% and then is exposed in a flaky form to gaseous ozone. In doing so, the pulp is introduced into a reaction vessel through which an ozonized gas flow passes. Subsequently, the pulp is washed in order to remove the undesired degradation products formed during bleaching.

This process has the disadvantage that special devices must be provided for slushing and diluting the pulp. Moreover, the pulp will not be bleached uniformly because of the pulp flakes having high consistencies.

According to another process, pulp is bleached at low consistencies of about 3% (low-consistency process). An ozonized gas is conducted through a pulp slurry. This process involves the handling of large amounts of liquids due to intensive dilution and accordingly comprehensive apparative equipment in large-scale operation.

The invention aims at avoiding these disadvantages and has as its object to provide an improved process for bleaching cellulosic materials, in particular pulp, by means of ozone.

SUMMARY OF THE INVENTION

In accordance with the invention, this object is achieved in that a solution of ozone in an aqueous medium (strong water) having an $O_3$-content of 30 to 300 g, preferably 100 to 150 g, per $m^3$ of aqueous medium is supplied under pressure to the materials suspended in an aqueous medium and is mixed therewith in a mixing device, whereupon the mixture is conducted through a reaction vessel, the bleached material is separated from the bleaching liquor, and possibly present residual ozone is destroyed, the process according to the invention being feasible also continuously.

Thus, with the process according to the invention, ozone, at first, is dissolved in an aqueous medium, whereby a concentrated ozone solution is obtained, which is denoted as strong water and which is mixed under pressure with the suspension of the stock to be bleached.

It has proved advantageous to produce the concentrated ozone solution in an absorption column, in which an aqueous medium is treated with an ozonic gas under pressure, which ozonic gas contains at least 100 g ozone/$Nm^3$ oxygen, wherein the ozone solution and the residual oxygen are withdrawn from the column and the residual oxygen is dried and recycled to the production of ozonic gas.

A preferred embodiment of the process according to the invention is characterized in that an overpressure of between 5 and 10 bar is provided in the absorption column and overpressures of between 2 and 5 bar are provided in the mixing device as well as in the reaction vessel, the overpressure within the absorption column being higher than those of the mixing device and the reaction vessel.

The bleaching process according to the invention optimally is carried out at a temperature of below 60° C., preferably of between 25° and 40° C.

Another embodiment of the process according to the invention is characterized in that a portion of the bleaching liquor is pretreated with ozone after separation of the bleached material and is recycled into the absorption column for the production of the concentrated ozone solution.

The process according to the invention offers the advantage that cellulosic materials can be bleached that have higher consistencies than are feasible according to the low-consistency process, wherein the consistency may amount up to 15% without a noticeable loss of the bleaching quality occurring.

Furthermore, the bleaching agent may be utilized in a much better way on account of the ozone added in the dissolved state, because the amount of ozone required is exactly calculatable. In the low-consistency process, according to which ozone is conducted through the pulp slurry in the gaseous form, ozone losses are unavoidable.

If larger amounts of ozone are required in the process according to the invention, it has proved favorable to carry out bleaching in two stages. For the second bleaching stage, the suspension is slushed and then treated a second time with fresh strong water.

The invention also relates to a plant for carrying out the process according to the invention, comprising an arrangement for preparing a pulp suspension, at least one bleaching tower as the reaction vessel, an arrangement for producing an ozonic gas, filtering means, pumps and ducts for connecting the plant parts, which is characterized in that the arrangement for producing ozone is flow-connected with an absorption column for the preparation of strong water, a mixing arrangement is provided for mixing the pulp suspension with the strong water, which mixing arrangement is connected with the absorption column via a strong water duct, and a bleaching tower is provided to receive the mixture of pulp suspension and strong water, the absorption column, the mixing arrangement and the bleaching tower being equipped with means for generating and adjusting an overpressure.

The bleaching tower may be connected to a filter via a discharge duct to separate the bleached pulp from the bleaching liquor, which filter includes a bleaching liquor duct for recycling spent bleaching liquor into the arrangement for preparing the pulp suspension.

The bleaching liquor duct, suitably, is flow-connected with the absorption column via a branch duct provided with a heat exchanger communicating also with the strong water duct in order to enable the heat transfer from the bleaching liquor to the strong water.

Another embodiment of the plant according to the invention is characterized in that the absorption column is connected with a return duct leading to the ozone generator in order to conduct non-dissolved oxygen from the absorption column back to the ozone generator, a drier preferably being arranged within the return duct.

BRIEF DESCRIPTION OF THE DRAWINGS

FIG. 1 is a diagrammatic view of a preferred embodiment of the plant according to the invention.

DETAILED DESCRIPTION OF THE PREFERRED EMBODIMENTS

An ozone generator is denoted by 1, an absorption column is denoted by 2 and a drier is denoted by 3. The absorption column 2 is connected with the mixer 5 by a strong water duct 4 via the heat exchanger 22 and the valve 23, which mixer, in turn, communicates with the lower end of a bleaching tower 7 via a feed duct 6. From top of the bleaching tower 7, an ozone duct 8 leads to the residual-ozone destroyer 9 and a discharge duct 10 leads to a filter 12 via a pump 11, the filter 12 communicating with a filter 14 via a bleaching liquor duct 13. From the bleaching liquor duct 13, a branch duct **13*a* leads to a backwater pretreatment stage 25 via a heat exchanger 22, which backwater pretreatment stage, in turn, is connected with the top of the absorption column 2 via a backwater duct 15 and a heat exchanger 24 including feed and discharge ducts 24*a*, 24*b*** for the heat transfer medium.

The process according to the invention is realized by initally preparing a pulp having a consistency of, for instance, between 10 and 15% in the filter 14. This pulp is conveyed into the mixer 5 by means of the pump 16 through pulp duct 17 and, there, is intimately mixed with strong water to a solution having a consistency of between 2 and 5%.

The strong water is formed in the absorption column 2 by treating backwater fed from the backwater pretreatment stage 25 via the backwater duct 15 into the top of the absorption column 2 after having been brought to the temperature required for the preparation of strong water in the heat exchanger 24, with ozonic gas at an overpressure of up to 8 bar. This gas is produced of oxygen in the ozone generator 1, contains more than 100 g $O_3/Nm^3$ $O_2$ and is introduced into the bottom end of the absorption column 2 in the ozone duct 18 from the ozone generator 1. Non-reacted gas may be returned to the ozone generator 1 via return duct 19 after having passed the drier 3. The return duct 19 runs into an oxygen duct 20, by which the ozone generator 1 is supplied with oxygen. The ozone content of the strong water is adjustable between 30 and 300 g $O_3/m^3$ water by appropriate selection of the pressure and temperature conditions.

The following $O_3$-concentrations are attainable in the strong water at a pressure of 7 bar and an ozone concentration of 130 g $O_3/Nm^3$ in the ozonic gas, depending on the temperature prevailing:

| Temperature (°C.) | $O_3$—concentration in strong water (g $O_3/m^3$ $H_2O$) |
|---|---|
| 15 | 290 |
| 20 | 215 |
| 25 | 195 |
| 30 | 150 |
| 35 | 110 |
| 40 | 70 |
| 50 | 30 |

The strong water is tapped on the lower end of the absorption column 2 and is fed to the mixer 5 through the strong water duct 4 via a valve 23. The valve 23 serves to reduce the pressure, which amounts to between 5 and 10 bar within the strong water duct, such that it amount to between 2 and 5 bar in the mixer 5 and in the bleaching tower 7.

Subsequently, the pulp/strong-water mixture is introduced into the lower end of the bleaching tower 7 and is conveyed to the upper end of the same over a period of about 20 minutes. During this period, the bleaching of pulp proper takes place.

Any excessive ozone possibly present on top of the bleaching tower 7 can be supplied to the residual-ozone destroyer 9 through the ozone duct 8.

Likewisely, the bleached pulp is discharged on top of the bleaching tower 7 and is introduced into the filter 12 through the discharge duct 10 by means of the pump 11 to separate the bleached pulp from the bleaching liquor. In the drawing, the removal of the bleached pulp is indicated by 21.

The bleaching liquor can be recycled into the filter 14 to adjust the consistency of oncoming pulp to be bleached. However, it may also be used to prepare strong water, in which case it must be pretreated with ozone prior to being introduced into the absorption column 2. This applicability is outlined in the drawing by the branch duct **13*a*, the backwater pretreatment stage 25 and the backwater duct 15. The ozone for pretreating is taken from the ozone duct 18**.

Suitably, a heat exchanger 22 is provided within the branch duct **13*a* in order to be able to recover heat from the bleaching liquor (about 50° C.). By means of this heat, the strong water in the strong water duct 4** is brought to a temperature, preferably, of about 46° C.

The process according to the invention may be realized even with several consecutive bleaching stages. To this end, at least one additional bleaching tower is arranged to follow the bleaching tower 7. The pulp suspension, suitably, is slushed before the second addition of strong water.

The invention will be explained in even more detail in the following exemplary embodiments:

EXAMPLE 1

Pretreated pulp having a consistency of 12% was treated with an ozone amount of 2 kg ozone per ton of pulp. The ozone solution (strong water) had a concentration of 80 g ozone per $m^3$.

The ozone solution was admixed to the pulp suspension in a mixer prior to entering the upwardly operating bleaching tower. When entering the bleaching tower, an ozone concentration of 61.86 g/$m^3$ had adjusted due to the admixture of the pulp. The initially rapid ozone consumption as well as the hydrostatic pressure prevailing within the bleaching vessel prevented the rapid gas evolution of the ozone in the starting phase of bleaching such that no bleeding through the amount of pulp to be bleached occurred.

Although the amount of ozone applied was low, an increase in the whiteness of the pulp by 4 points could be attained, nevertheless. In the following, degrees of whiteness of 80 were reached by conventional after-treatment. The residence time within the bleaching tower was 20 minutes. The consistency was 3%.

EXAMPLE 2

Pretreated pulp having a consistency of 14% was treated with 4 kg ozone per ton of pulp. The consistency during bleaching amounted to 2%. The strong water contained 93.3 g $O_3/m^3$. The overpressure prevailing within the bleaching tower was 4 bar.

By the treatment with ozone, the kappa number could be reduced by 2 units and, in addition, a gain in whiteness by 5 points was reached.

EXAMPLE 3

Pretreated pulp having a consistency of 14% was bleached with 10 kg ozone per ton of pulp. In this case, bleaching was effected in two stages.

At first, the pulp was adjusted to a consistency of 2% by the addition of ozone solution. After bleaching for 20 minutes in an upwardly operating bleaching tower under pressure, the suspension was slushed to 5%. Subsequently, further admixture of ozone solution to a consistency of 2% was effected. The concentration of the ozone solution was 137.2 g $O_3/m^3$.

Also the second bleaching stage was carried out in an upwardly operating bleaching tower under pressure. In either case, the bleaching time was 20 minutes. In the instant case, a kappa reduction by 7 units at an increase in the degree of whiteness by 6 points could be achieved.

What is claimed is:

1. A process for bleaching cellulosic materials using ozone, comprising the steps of:

providing a first aqueous medium to suspend said cellulosic materials therein so as to obtain a pulp suspension, providing an absorption column prior to said bleaching for dissolving ozone in a second aqueous medium so as to obtain a concentrated ozone solution having a content of ozone of 30 to 300 g $O_3$ per $m^3$ of said second aqueous medium, feeding said concentrated ozone solution under pressure to said pulp suspension, providing a mixing means to mix said pulp suspension with said concentrated ozone solution so as to obtain a mixture, providing a reaction vessel to let said mixture pass therethrough so as to obtain bleached material and a bleaching liquor, providing an overpressure of between 5 bar and 10 bar in said absorption column, and providing an overpressure of between 2 bar and 5 bar in both said mixing means and said reaction vessel, separating said bleached material from said bleaching liquor, and destroying possibly present residual ozone.

2. A process as set forth in claim 1, wherein said concentrated ozone solution has a content of 100 to 150 g $O_3$ per $m^3$ of said second aqueous medium.

3. A process as set forth in claim 1, further comprising:

treating said second aqueous medium in said absorption column under pressure with an ozonic gas containing at least 100 g $O_3/Nm^3$ oxygen so as to obtain said concentrated ozone solution, withdrawing said concentrated ozone solution and residual oxygen from said column, and drying said residual oxygen and recycling the dried residual oxygen to the preparation of ozonic gas.

4. A process as set forth in claim 3, wherein the overpressure prevailing in said absorption column is adjusted to be higher than the overpressure prevailing in said mixing means and in said reaction vessel.

5. A process as set forth in claim 1, wherein said process is carried out continuously.

6. A process as set forth in claim 1, further comprising maintaining the temperature during reaction at below 60° C.

7. A process as set forth in claim 6, wherein said temperature during reaction is maintained at between 25° and 40° C.

8. A process as set forth in claim 3, further comprising pretreating a portion of said bleaching liquor, after separation from said bleached material, with ozone so as to obtain a pretreated liquor, and recycling said pretreated liquor into said absorption column for preparing said concentrated ozone solution.

9. A plant for bleaching cellulosic materials, comprising a pulp suspension preparing means containing a first aqueous medium for suspending said cellulosic materials therein to obtain a pulp suspension, an ozone generating means for providing an ozonic gas, an absorption column being in flow-connection with said ozone generating means and containing a second aqueous medium for dissolving said ozonic gas therein to obtain a concentrated ozone solution having a content of ozone of 30 to 300 g $O_3$ per $m^3$ of said second aqueous medium, a mixing means adapted to mix said pulp suspension with said concentrated ozone solution to obtain a mixture, a concentrated ozone solution duct adapted to connect said mixing means with said adsorption column, at least one reaction vessel designed as a bleaching tower adapted to receive said mixture of pulp suspension and concentrated ozone solution and to let said mixture pass therethrough to obtain bleached material and a bleaching liquor, filtering means, pump means and duct means, and overpressure generating and adjusting means provided in said absorption column, in said mixing means and in said bleaching tower.

10. A plant as set forth in claim 9, wherein said duct means comprise a discharge duct and a bleaching liquor duct and said filtering means comprise a first filter for separating bleached pulp from bleaching liquor, said discharge duct being provided to connect said bleaching tower with said first filter and said bleaching liquor duct being provided in said said first filter and adapted to return spent bleaching liquor into said pulp suspension preparing means.

11. A plant as set forth in claim 10, further comprising a branch duct adapted to flow-connect said bleaching liquor duct with said absorption column and a heat exchanger provided in said branch duct, said heat exchanger also communicating with said concentrated ozone solution duct to allow for heat transfer from said bleaching liquor to said ozone solution.

12. A plant as set forth in claim 9, wherein said duct means further comprise a return duct connected to said absorption column and leading to said ozone generating means for recycling non-dissolved oxygen from said absorption column to said ozone generating means.

13. A plant as set forth in claim 12, further comprising a drier provided in said return duct.

14. The process of claim 1, wherein the cellulosic material is pulp.

15. The plant of claim 9, wherein the cellulosic material is pulp.

* * * * *

UNITED STATES PATENT AND TRADEMARK OFFICE

CERTIFICATE OF CORRECTION

PATENT NO. : 5,133,946

DATED : July 28, 1992

INVENTOR(S) : Karl Schwarzl

It is certified that error appears in the above-identified patent and that said Letters Patent is hereby corrected as shown below:

Title Page: Change the assignee to: Schmidding-Werke Wilhelm Schmidding GMBH & Co., Cologne, Federal Republic of Germany Signed and Sealed this Twenty-ninth Day of March, 1994

*Attest:*

Bruce Lehman

BRUCE LEHMAN

*Attesting Officer*

*Commissioner of Patents and Trademarks*